US010547141B2

(12) United States Patent
Alrashed

(10) Patent No.: US 10,547,141 B2
(45) Date of Patent: Jan. 28, 2020

(54) FLAT-PORT CONNECTORS

(71) Applicant: KING ABDULLAH UNIVERSITY OF SCIENCE AND TECHNOLOGY, Thuwal (SA)

(72) Inventor: Mohammed M. Alrashed, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 15/767,725

(22) PCT Filed: Nov. 17, 2016

(86) PCT No.: PCT/IB2016/056928

§ 371 (c)(1),
(2) Date: Apr. 12, 2018

(87) PCT Pub. No.: WO2017/085663

PCT Pub. Date: May 26, 2017

(65) Prior Publication Data

US 2018/0309233 A1 Oct. 25, 2018

Related U.S. Application Data

(60) Provisional application No. 62/257,325, filed on Nov. 19, 2015.

(51) Int. Cl.

| | |
|---|---|
| ***H01R 24/38*** | (2011.01) |
| ***H01R 13/62*** | (2006.01) |
| *H01R 105/00* | (2006.01) |

(52) U.S. Cl.

CPC ..... *H01R 13/6205* (2013.01); *H01R 24/38* (2013.01); *H01R 2105/00* (2013.01); *H01R 2201/16* (2013.01)

(58) Field of Classification Search

CPC ..... H01R 13/6205; H01R 24/38; H01R 2105/00; H01R 2201/16

See application file for complete search history.

(56) References Cited

U.S. PATENT DOCUMENTS 8,894,419 B1 * 11/2014 Buelow ..... H01R 13/6205 439/218

2006/0061953 A1 3/2006 Le (Continued)

FOREIGN PATENT DOCUMENTS

WO 2014010781 A1 1/2014

OTHER PUBLICATIONS

International Search Report in related International Application No. PCT/IB2016/056928, dated Feb. 21, 2017.

(Continued)

*Primary Examiner* — Truc T Nguyen

(74) *Attorney, Agent, or Firm* — Patent Portfolio Builders PLLC

(57) ABSTRACT

Disclosed are various embodiments for connectors used with electronic devices, such as input and/or output ports to connect peripheral equipment or accessories. More specifically, various flat-port are provided that can be used in place of standard connectors including, but not limited to, audio jacks and Universal Serial Bus (USB) ports. The flat-port connectors are an alternate connection design to replace the traditional receptacle port (female-port), making the device more sealed creation more dust and water resistant. It is unique in the way of using the outer surfaces of the device for the electrical connection between the ports. Flat-port design can allow the manufacture of extremely thin devices by eliminating the side ports slots that take a lot of space and contribute to the increase thickness of the device. The flat-port receptacle improves the overall appearance of the device and makes it more resistant to dust and water.

17 Claims, 5 Drawing Sheets

(56) References Cited

U.S. PATENT DOCUMENTS

| | | | | |
|---|---|---|---|---|
| 2007/0072442 | A1* | 3/2007 | DiFonzo | H01R 13/641 439/39 |
| 2010/0100662 | A1 | 4/2010 | Perng | |
| 2011/0104941 | A1* | 5/2011 | Chang | H01R 13/6315 439/530 |
| 2012/0164849 | A1 | 6/2012 | Lee et al. | |
| 2013/0273752 | A1* | 10/2013 | Rudisill | H01R 13/6205 439/39 |
| 2014/0057463 | A1* | 2/2014 | Bhimavarapu | H01R 13/6205 439/39 |
| 2014/0148018 | A1* | 5/2014 | Kim | H01R 13/24 439/39 |
| 2014/0235075 | A1* | 8/2014 | Kim | H01R 13/6205 439/39 |
| 2015/0031220 | A1* | 1/2015 | Fang | H01R 13/6205 439/38 |
| 2015/0093922 | A1* | 4/2015 | Bosscher | H01R 13/665 439/39 |
| 2015/0132992 | A1* | 5/2015 | Holland | H01R 13/6474 439/578 |
| 2015/0194764 | A1* | 7/2015 | Magana | H01R 13/6205 439/39 |
| 2016/0020553 | A1* | 1/2016 | Little | H01R 13/2435 439/38 |
| 2016/0141809 | A1* | 5/2016 | Choi | H01R 13/6683 439/38 |

OTHER PUBLICATIONS

Written Opinion of the International Searching Authority in related International Application No. PCT/IB2016/056928, dated Feb. 21, 2017.

* cited by examiner

FLAT-PORT CONNECTORS

CROSS-REFERENCE TO RELATED APPLICATIONS

This application is a U.S. National Stage Application of International Application No. PCT/IB2016/056928, filed on Nov. 17, 2016, which claims the benefit of and priority to U.S. Provisional Application Ser. No. 62/257,325, having the title "FLAT-PORT CONNECTORS," filed on Nov. 19, 2015, the disclosures of which are incorporated herein by reference in their entirety.

TECHNICAL FIELD

This disclosure relates to connectors used with electronic devices. More specifically, this disclosure concerns connectors that can be used as an alternative to standard connectors, such as headphone jacks or USB ports.

BACKGROUND

Electrical connectors are used in conjunction with various electrical devices from computers to portable media players. The required type of connector varies greatly, but usually depends on the application, (e.g. audio signal, data transfer, power, etc.). As necessitated by advancement of technology and the requirements of specific devices, a wide variety of connectors can be used depending on the intended use and/or requirements of specific manufacturers.

With the tremendous increase in demand for ultra-thin devices, designers find a new challenge of accommodating technical needs, based on existing hardware. The standardization and miniaturization of electrical connectors, in particular of some input and/or output ports, have been developed with technology progression. Yet there are still limitations in size when trying to incorporate such ports into ultra-thin devices.

For many designers and product developers, the solution is to minimize the number of ports and utilize wireless technology for data transfers. However, this poses a problem to the heavy user who may need to connect multiple peripheral devices or wish to transfer large files. A multi-port adapter may be used to accommodate additional peripherals, but this may be a limited solution if a device has only one universal port that must also be used for power.

SUMMARY

The present disclosure addresses the aforementioned limitations.

In various aspects, flat-port connectors and systems are provided herein to address these limitations. In an embodiment a flat-port plug (male port) is provided. The flat-port plug (male-port) can be flexible, for example made of one or more flexible electrical contacts, which can be placed on a flat, outer flexible plastic base layer. The base layer of the flat-port plug can be any suitable dielectric material, such as nylon, epoxy/fiberglass, or thermoplastic. In various aspects the base layer can be fabricated having opposed, flat outer surfaces, wherein for example the opposed flat outer surfaces are substantially parallel to each other and the base has a generally rectangular cross-section. In some aspects the sides of the cross-section between and connecting the opposed, flat surfaces can be formed as substantially parallel surfaces forming either a rectangular or a trapezoidal cross-section or can be arcuate or curved or other configuration.

In order to minimize the space utilized by a headphone jack, a USB port, or any other port, the outer surface of the device can be used. As described the outer surface can be flat surface. This can be achieved by welding, printing, or otherwise applying one or more physical electrical contacts on the outer flat surface of the devices. The contacts can be fabricated with electrically conducting material, such as copper, silver, gold, an alloy, or other material suitable for conducting electricity. The electrically conducting contact(s) can be on, embedded in, or separated by a dielectric material. By dispensing the traditional jack (female-port), the device can be sealed making it more dust and water resistant.

The one or more electrically conducting contacts of the flat-port plug (male-port) can extend or protrude out part of the plastic layer; these electrically conducting contacts can connect with the flat-port receptacle (female-port) at the outer surface of the device. In order to securely connect the plug and receptacle, a strong magnetic contact can be utilized. The magnetic contact can be provided on the same flat outer surface as the one or more electrical contacts. For example, one or more magnetic contacts can be used. In some aspects a pair of magnetic contacts can be used: one having a positive polarity and one having a negative polarity. In one or more aspects, a magnetic contact can be utilized on opposed sides of the electrically conducting contacts, but with opposite polarity. The magnetic contact(s) can also ensure alignment of the electrically conducting contacts on both the plug and receptacle, facilitating use. The magnetic contact(s) are not limited in shape to strips, but can also be circular, polygonal, non-linear or other shape. More than two magnetic contacts can be used with at least two of opposite polarity to assist in creating a key for proper alignment of the electrically conducting contacts.

The flat-port receptacle is an alternate connection design to replace the traditional receptacle port (female-port), making the device a more sealed creation and more dust and water resistant. It is unique in the way of using the outer surfaces of the device for the connection between the ports. The flat-port design can allow the manufacture of extremely thin devices by eliminating the side ports slots that take a lot of space and contribute to the increase thickness of the device. The flat-port receptacle improves the overall appearance of the device and can make it more resistant to dust and water.

In various embodiments, our flat-port connector can be used for headphones.

Four conductors are typically used for audio plugs, but the standard for TRRS (tip, ring1, ring2, sleeve) can vary by manufacturer. For example, a headphone plug can have between 2 to 4 conductors, with the order of the conductors altered according to the company standard utilized. Some headphone audio plugs are used for stereo, while others have only a single audio (mono) signal. While others can also have a provision to carry a microphone signal.

In various embodiments, a flat-port connector can be used to replace a universal port. Most portable electronic devices have at minimum one USB port or proprietary port for data transfer and/or power. The trend is to minimize the ports and openings on a device to minimize the exposure of internal circuitry to dust, water, or other contaminants. Although it may be possible to utilize this main universal port for audio or data transfer, a problem is created when the port is being used for power, with no alternative available. Vi-fi or Bluetooth can be used for some applications, but it is not always suitable for the needed application.

In an embodiment a port connector is provided. The port connector can comprise a base fabricated of a dielectric material having a substantially flat surface; at least one magnetic contact disposed within the substantially flat surface, and a plurality of flat electrically conducting contacts disposed within the substantially flat surface.

In any one or more aspects, the at least one magnetic contact can be an endless track and the plurality of electrically conducting contacts can be concentric circles positioned about the magnetic contact. The at least one magnetic contact can comprise a plurality of magnetic contacts; wherein at least one magnetic contact has positive polarity; and wherein at least one magnetic contact has negative polarity. The plurality of magnetic contacts can be spaced apart and the plurality of electrically conducting contacts can be disposed between the magnetic contacts. The base can be flexible. The port connector can be embedded in a portable device. The plurality of contacts can comprise a left audio contact, a right audio contact, a ground contact, and a microphone contact. The plurality of flat magnetic contacts can be a pair parallel magnetic strips with opposite polarity and the flat electrically conducting contacts can be parallel strips disposed transversely between the magnetic strips. The plurality of contacts can comprise a ground contact, a data+ contact, a data− contact, and a voltage (+5V) contact. The plurality of flat magnetic contacts can be a pair parallel magnetic strips with opposite polarity and the flat electrically conducting contacts can be parallel strips disposed in parallel between the magnetic strips.

In an embodiment a port connector is provided that can comprise a base fabricated of a dielectric material having a substantially flat surface; at least one magnetic contact on the substantially flat surface arranged to magnetically attract at least one corresponding magnetic contact on a complementary port connector, and a plurality of electrically conducting contacts on the substantially flat surface, wherein each of the electrically conducting contacts are arranged to mate with a corresponding electrically conducting contact on a complementary port connector.

In any one or more aspects, the base of the port connector can be the surface of a device. The at least one magnetic contact can be an endless track and the plurality of electrically conducting contacts can be concentric circles positioned about the magnetic contact. The at least one magnetic contact can comprise a plurality of magnetic contacts; wherein only a single surface of each of the magnetic contacts is exposed; wherein at least one magnetic contact has positive polarity; wherein at least one magnetic contact has negative polarity; and wherein the at least one magnetic contact are spaced apart and the plurality of electrically conducting contacts are disposed between the magnetic contacts. The plurality of electrically conducting contacts can comprise a left audio contact, a right audio contact, a ground contact, and a microphone contact. The plurality of contacts can comprise: a voltage (+5V) contact, a data− contact, a data+ contact, and a ground contact.

In an embodiment, a system of port connectors is provided. The system can comprise a first port connector and a second port connector that are configured to be matingly connected to form a conductive path; wherein the first port connector comprises: a base, with a substantially flat surface; at least one magnetic contact disposed within the substantially flat surface; and a plurality of electrically conducting contacts disposed within the substantially flat surface; and wherein the second port connector comprises: a base, with a substantially flat surface; at least one magnetic contact on the substantially flat surface, having a polarity to magnetically attract to a corresponding magnetic contact of the first port connector, and a plurality of electrically conducting contacts on the substantially flat surface, wherein each of the electrically conducting contacts are arranged to mate with a corresponding electrically conducting contact in the first port connector, thereby forming one or more conductive paths for signal or power.

In any one or more aspects, the at least one magnetic contact can comprise a plurality of magnetic contacts; wherein at least one magnetic contact has positive polarity and at least one magnetic contact has negative polarity. The plurality of electrically conducting contacts on the first port connector can comprise a ground contact, a left audio contact, a right audio contact, and a microphone contact; and the plurality of electrically conducting contacts on the second port connector comprise: a ground contact, a left audio contact, a right audio contact, and a microphone contact. The plurality of electrically conducting contacts on the first port connector can comprise: a ground contact, a data+ contact, a data1 contact, and a voltage contact; and the plurality of electrically conducting contacts on the second port connector comprise: a voltage contact, a data− contact, a data+ contact, and a ground contact.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Described below are various embodiments of the present systems and methods for flat-port connectors. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

Discussion

In today's market, there are devices for which the overall thickness is defined by the dimensions of the headphone jack. For instance, the new Apple MacBook has a maximum thickness of 0.52 cm for the device and is only 0.14 cm as the thinnest edge. The height for a standard headphone port is about 19 mm and the height of USB jacks range from about 6.8-12 mm. Limitations of the interior space of the device can be overcome if alternative technology is considered.

The present disclosure is directed to overcoming limitations of interior space of various devices. In various aspects, the present disclosure relates to connectors used with electronic devices, such as input and/or output ports to connect peripheral equipment or accessories. Most commonly, an electrical signal can be conducted from a device to a peripheral using a system of connectors typically comprising a jack or receptacle on the device and a plug on the peripheral.

The required type of connector varies greatly, but usually depends on the application, (e.g. audio signal, data transfer, power, etc.). More specifically, this disclosure concerns connectors that can be used in place of standard connectors including, but not limited to, audio jacks and Universal Serial Bus (USB) ports.

DESCRIPTION

In the following discussion, a general description of the present flat-port connectors and systems and their components is provided, followed by a discussion of the operation of the same.

Figure 1:
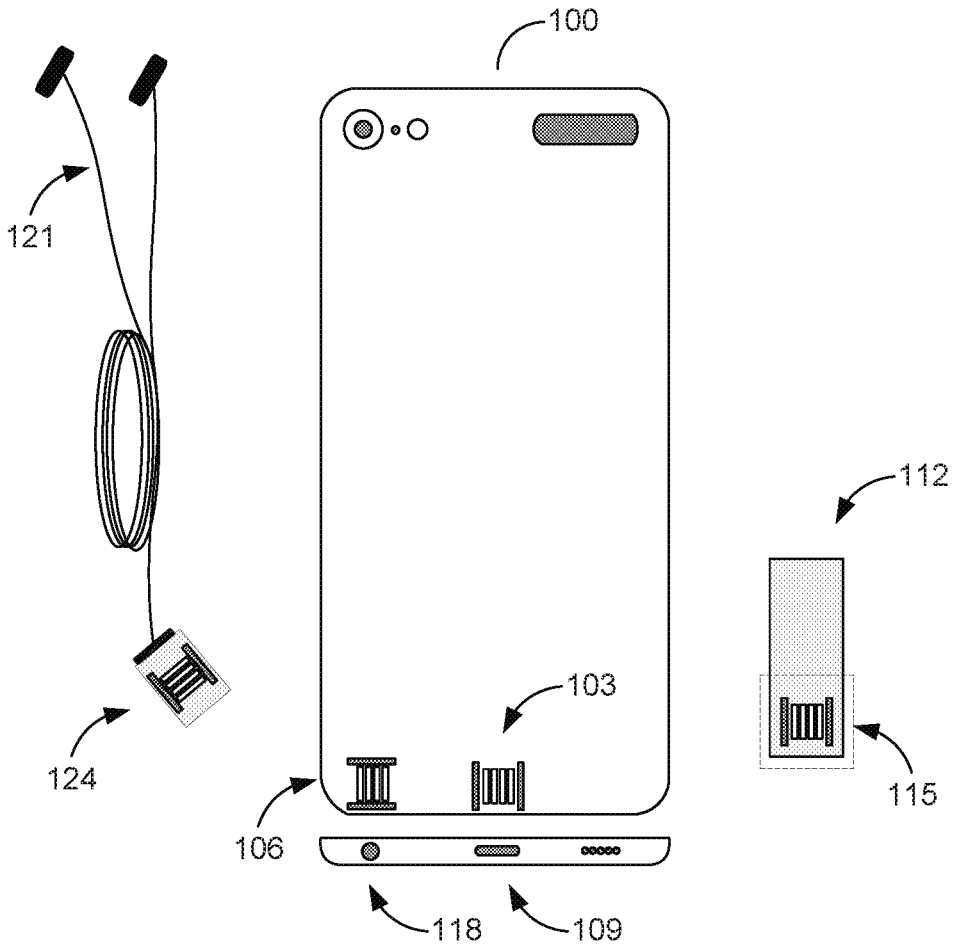
FIG. 1 illustrates example of an ultra-thin device with flat-port connectors according to various embodiments of present disclosure.

With reference to FIG. 1, shown is a drawing exemplifying an ultra-thin device 100 of the present disclosure with a universal flat-port receptacle 103 and headphone flat-port receptacle 106 integrated within the ultra-thin device 100. In some embodiments, the flat-port USB receptacle 103 can be used as replacement or in addition to the standard micro-USB port 109 to connect with a data storage device 112 using the integrated flat-port USB plug 115. In additional embodiments, the flat-port headphone receptacle 106 can be used as replacement or in addition to standard 3.5 mm headphone jack 118 to connect headphones 121 using a headphone flat-port plug 124.

Figure 2A:
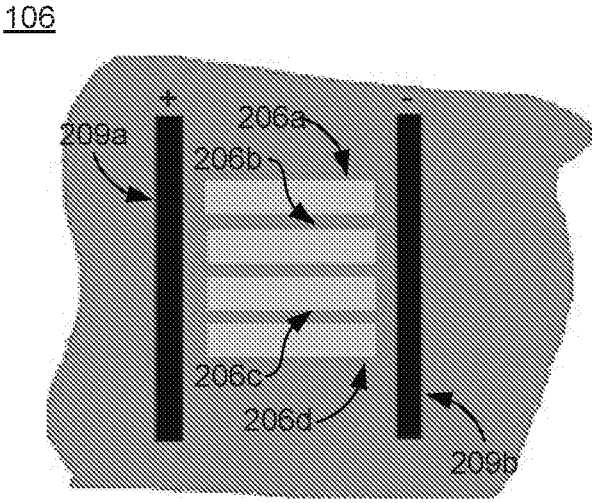
FIGS. 2A and 2B illustrate examples of headphone flat-port connectors according to various embodiments of present disclosure.

Referring next to FIG. 2A, an enlarged depiction of an embodiment of a flat-port audio or headphone receptacle 106 is shown. In some embodiments, the flat-port headphone receptacle 106 is comprised of a plurality of contacts 206*a* . . . 206*d* disposed between a pair of magnetic strips 209*a* and 209*b* of opposite polarity. The contacts can be made of an electrically conducting material, such as copper, and configured to electrically connect and conduct signal according to a headphone standard. In one embodiment, the pair of magnetic strips 209*a* and 209*b* can be used to secure the headphone plug 124 when connected to headphone receptacle 106, with magnetic strip 209*a* of positive polarity and magnetic strip 209*b* of negative polarity, in order to ensure proper orientation of the headphone plug 124 when connected to headphone receptacle 106. In some embodiments, the plurality of contacts can be configured in accordance with a headphone standard such that the first contact 206*a* is designated for left audio connection, the second contact 206*b* is designated for right audio connection, the third contact 206*c* is designated for ground connection, and the fourth contact 206*d* is designated for microphone connection. In other embodiments, the order of electrical connections and pin-out required is dependent on the specified audio standard. Similarly, the positioning of the may be reversed depending on usage.

Figure 2B:
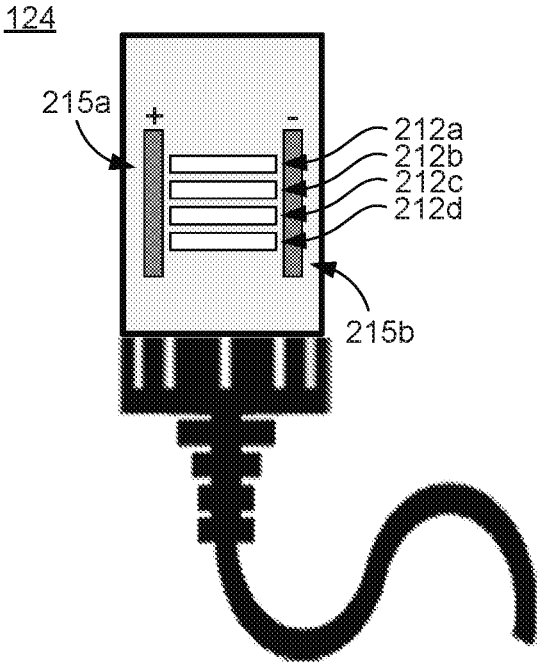

Moving on to FIG. 2B, an enlarged depiction of an embodiment of a flat-port headphone plug 124 is shown. In some embodiments, the flat-port headphone plug 124 can be comprised of a plurality of contacts 212*a* . . . 212*d* disposed between a pair of opposed magnetic strips 215*a* and 215*b* of opposite polarity. The contacts can be made of an electrically conducting material, such as copper and configured to electrically connect and conduct signal according to a headphone standard. In some embodiments, the pair of magnetic strips 215*a* and 215*b* can be used to secure the headphone plug 124 when connected to headphone receptacle 106, with magnetic strip 215*a* of positive polarity and 215*b* of negative polarity, in order to ensure proper orientation of the headphone plug 124 when connected to headphone receptacle 106. In some embodiments, the plurality of contacts can be configured in accordance with a headphone standard such that the first contact 212*a* can be designated for left audio connection, the second contact 212*b* designated for right audio connection, the third contact 212*c* designated for ground connection, and the fourth contact 212*d* designated for microphone connection.

Figure 3A:
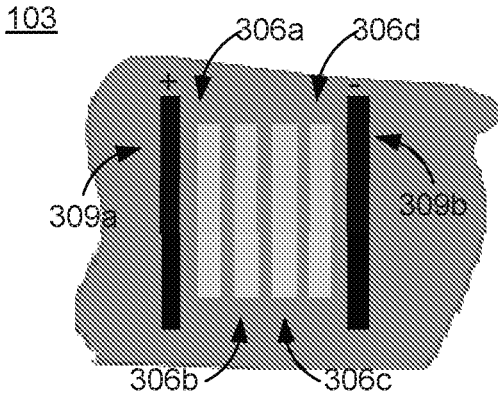
FIGS. 3A and 3B illustrate examples of USB flat-port connectors according to various embodiments of present disclosure.

Referring next to FIG. 3A, an enlarged depiction of a flat-port universal receptacle 103 is shown. In some embodiments, the flat-port universal receptacle can be comprised of a plurality of contacts 306*a* . . . 306*d* and a pair of magnetic strips 309*a* and 309*b* of opposite polarity. The contacts can be made of an electrically conducting material, such as copper and configured to electrically connect and conduct signal according to a USB standard. In some embodiments, the pair of magnetic strips 309*a* and 309*b* can be used to secure the universal plug 115 when connected to universal receptacle 103, with magnetic strip 309*a* of positive polarity and 309*b* of negative polarity, in order to ensure proper orientation of the universal plug 115 when connected to universal receptacle 103. In some embodiments, the plurality of contacts can be configured in accordance with a USB standard such that the first contact 306*a* can be designated for Vcc (+5V) connection, the second contact 306*b* designated for data− connection, the third contact 306*c* designated for data+ connection, and the fourth contact 306*d* designated for ground connection. In other embodiments, the order of electrical connections and pin-out required is dependent on the specified standard. Similarly, the positioning of the may be reversed depending on usage.

Figure 3B:
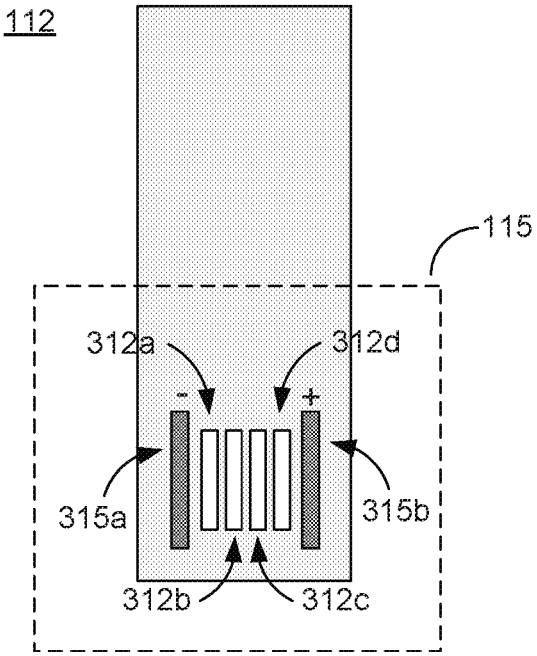

Similarly, in FIG. 3B, an embodiment of the corresponding flat-port universal plug 115 is shown as integrated into a portable data device 112, such as a flash drive. According to various embodiments, the flat-port universal plug 115 can be designed to mate with the flat-port universal receptacle 103. In some embodiments, a pair of magnetic strips 315*a* and 315*b* can be used to secure the universal plug 115 when connected to universal receptacle 103, with magnetic strip 315*a* of negative polarity and 315*b* of positive polarity, in order to ensure proper orientation of the universal plug 115 when connected to universal receptacle 103. In some embodiments, the plurality of contacts on the universal plug can be configured in accordance with a USB standard such that the first contact 312*a* can be designated for Vcc (+5V) connection, the second contact 312*b* designated for data− connection, the third contact 312*c* designated for data+ connection, and the fourth contact 312*d* designated for ground connection.

Figure 4A:
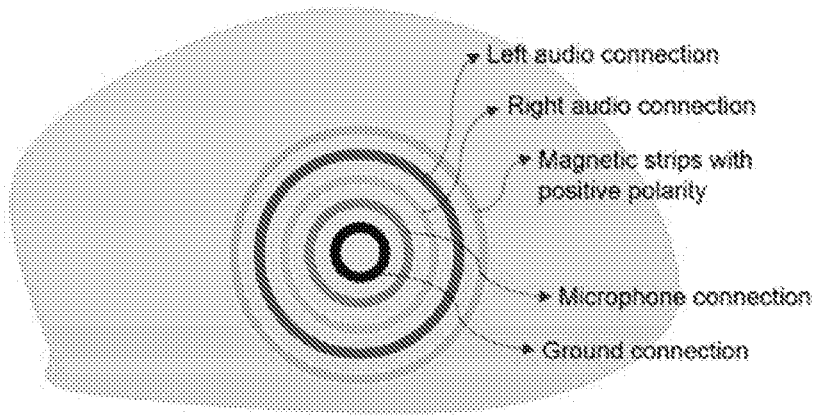
FIGS. 4A and 4B illustrate examples of circular flat-port connectors according to various embodiments of present disclosure.

With reference to FIG. 4A, an embodiment of a circular flat-port receptacle is shown. The concentric circle design allows for connection from any angle or direction. According to one embodiment, the exterior circle can have magnetic contact with a positive polarity. The interior circles can be electrically conducting contacts. For example, the electrically conducting contacts can start with a ground in the center, moving outward for a microphone connection, then right audio, then left audio, with a positive polarity magnetic contact at the most exterior. In other embodiments, the number of electrically conducting contacts and/or magnetic contacts can be designed with a different purpose.

Figure 4B:
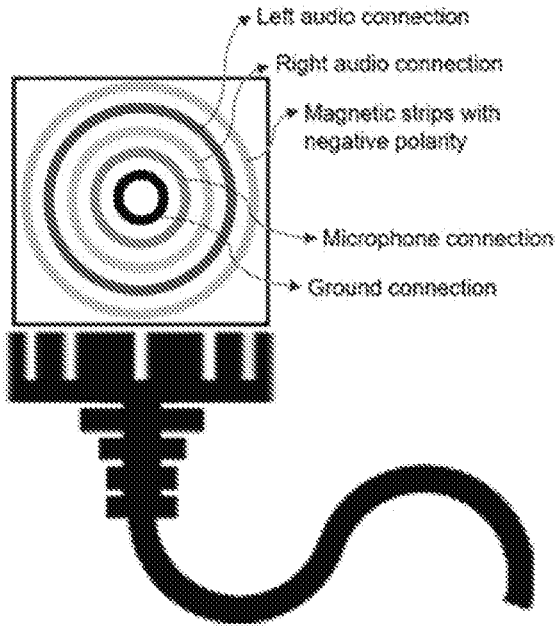

Referring next to FIG. 4B, an enlarged depiction of the corresponding flat-port universal plug is shown. The plug can be designed with a complementary layout to mate with the circular flat-port receptacle. For example, the electrically conducting contacts can start with a ground in the center, moving outward for a microphone connection, then right audio, then left audio, with a negative polarity magnetic contact at the most exterior. In other embodiments, the number of electrically conducting contacts and/or magnetic contacts can be designed with a different purpose.

Figure 5:
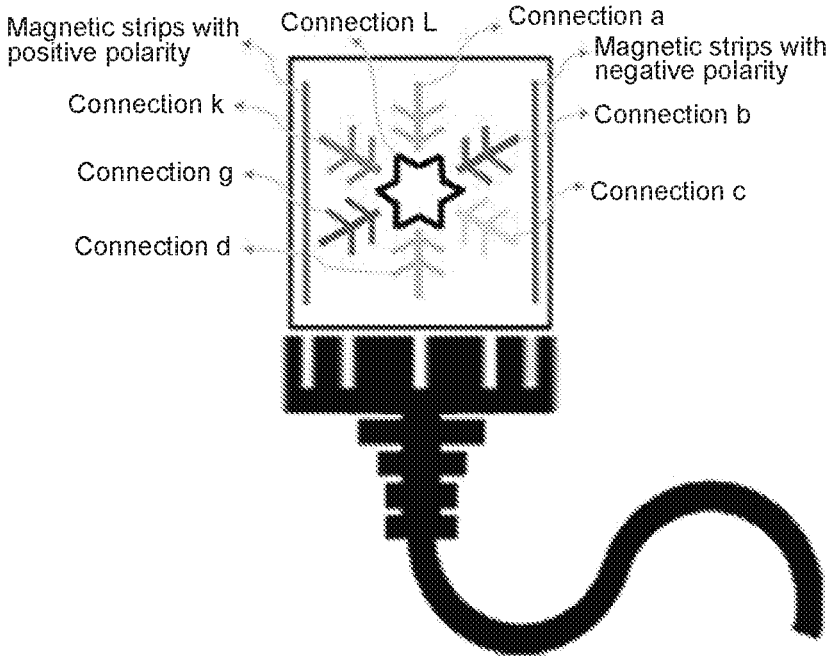
FIG. 5 illustrates an example of open design flat-port connectors according to various embodiments of present disclosure.

Moving on to FIG. 5, another embodiment of a flat-port universal design is shown. In this embodiment, a snowflake design (or other radiating design) can be used to allow for a unique design to differentiate the type of connector or brand, while maintaining the functionality necessary for the required purpose. For example, a geometric or star shaped electrically conducting contact can be used at center, with additional connections radiating outward which can resemble the shape of a snow flake.

In one or more embodiments, a port connector is provided comprising: a base, at least one magnetic contact, and a plurality of electrically conducting contacts. The base can have at least one substantially flat surface and made from a dielectric material. The flat magnetic contact can be disposed within the substantially flat surface, wherein only a single surface of the magnetic contact is exposed. The plurality of flat electrically conducting contacts can also be disposed within the same substantially flat surface.

The base of the port connector can provide at least one flat outer surface and can be fabricated of a dielectric material, such as nylon, epoxy/fiberglass, or thermoplastic. In various aspects the base can be fabricated having opposed, flat outer surfaces, wherein for example the opposed flat outer surfaces are substantially parallel to each other and the base has a generally rectangular cross-section. In some aspects the sides of the cross-section between and connecting the opposed, flat surfaces can be formed as substantially parallel surfaces forming either a rectangular or a trapezoidal cross-section or can be arcuate or curved or other configuration. In some embodiments, the base can be flexible. In other embodiments, the base can be the surface of a device. If the surface of the device is a conducting material, the port connector can be first disposed on a dielectric layer.

At least one flat magnetic contact is provided on the flat, outer surface of the base to secure the flat-plug to the flat receptacle. In an embodiment, this magnetic contact may be a circular or other endless track configuration to allow for connection in any direction. In other embodiments, two or more magnetic contacts can be used. The placement of the magnetic contact(s) can ensure proper alignment with the mating port and secure the electrically conducting contacts. The arrangement of conducting contacts and magnetic contact(s) can define the type of connector, so to lessen confusion. The plurality of magnetic contacts can include at least two contacts of opposite magnetic polarity. In various embodiments with two or more magnetic contacts, at least one magnetic contact having a positive polarity and at least one magnetic contact having a negative polarity can be included.

According to some embodiments, when at least two magnetic contacts are provided, they can be provided spaced apart and the plurality of electrically conducting contacts disposed between the magnetic contacts. In some embodiments, the at least two magnetic contacts can be a pair of parallel magnetic strips, each with opposite polarity, and the flat electrically conducting contacts can be parallel strips disposed between the magnetic strips. In some embodiments, the electrically conducting strips can be placed in parallel between the magnetic contacts or strips. In other embodiments, the electrically conducting strips can be placed transversely between the magnetic strips. The size and shape of the strips need not be limited to strips and can be other shapes that are sufficient in size for conducting the signal.

The flat-port connector can also be configured wherein specific orientation of the connector is not required. In some embodiments, one magnetic contact on the plug of one polarity and a corresponding magnetic connector on the receptacle of the opposite polarity can ensure proper contact of the plug to the receptacle at any angle or direction. In another embodiment, the flat magnetic connector can be an endless track, for example circular, oval or other similar configuration, having one polarity and the flat electrically conducting contacts can be circular and placed within the circular magnetic connector, forming concentric circles, or placed outwardly from the magnetic connector in the form of an endless track.

The connectors can be used in any port application. In various embodiments, the connectors can be used for headphones. There are currently multiple configurations for headphone plugs, based on the application and/or manufacturer. In some embodiments, the port connector can be configured with four electrically conducting contacts, which can comprise: a ground contact, a left audio contact, a right audio contact, and a microphone contact. While the physical port connector can appear the same, the defined order of contacts can be determined by the device manufacturer or a standard can be established. In some embodiments, the contacts can be consistent with current TRRS (tip, ring1, ring2, and sleeve) standards.

In other embodiments, one or more contacts can remain undefined or disconnected to wiring or electrical circuitry. This can be done to standardize production cost, but allow customization of use. In some embodiments, the headphone port connector can be four parallel electrically conducting strips disposed transversely between a pair of magnetically opposed magnetic strips preferably of opposite polarity. In one embodiment, a first magnetic strip can be of positive polarity and the second magnetic strip of negative polarity, each disposed separately apart and outwardly, with four electrically conducting strips disposed in parallel transversely in between the magnetic strips, configured with the top electrically conducting contact strip as left audio, the second electrically conducting contact strip as right audio, the third electrically conducting contact strip as ground, and the bottom electrically conducting contact strip as microphone.

In other embodiments, the port connector can be used similar to a USB connection and can be configured to comply with any of the USB standards, which is hereby incorporated by reference in its entirety. The plurality of contacts can comprise: a voltage (+5V) contact, a data− contact, a data+ contact, and a ground contact. In various embodiments, the electrical connectors can be configured with nine or more contacts to accommodate the SuperSpeed USB standard so that the pinout can include: VBUS, D−, D+, GRD, StdA_SSRX−, StdA_SSRX+, GRN_DRAIN, StdA_SSTX−, and StdA_SSTX+. The port connector can be embedded in a portable device, such as a flash drive.

In some embodiments, the port connector can include four parallel electrically conducting strips disposed in parallel in between and in parallel with a pair of magnetically opposed magnetic strips. In one embodiment, the first magnetic strip can be of positive polarity and the second magnetic strip of negative polarity, each disposed separately apart and outwardly, with four electrically conducting strips disposed in between and in parallel with the magnetic strips, configured with the first electrically conducting contact strip as Vcc (+5V), the second electrically conducting contact strip as data−, the third electrically conducting contact strip as data+, and the bottom electrically conducting contact strip as ground.

For a specified port connector, configured to be a plug on a peripheral device or accessory, a complementary port connector acting as a receptacle is provided. The receptacle port connector can be similar in appearance, but arranged to electrically complete signal paths when mated with the complementary plug port connector. The receptacle port connector can comprise: a base, at least one magnetic contact, and a plurality of electrically conducting contacts. In some embodiments, the base can be fabricated of a dielectric material and can have at least one substantially flat surface. The at least one magnetic contact on the substantially flat surface can be arranged or configured to magnetically attract to at least one magnetic contact on a complementary port connector with at least one magnetic contact of positive polarity and at least one magnetic contact of negative polarity. The plurality of electrically conducting contacts can also be disposed on the substantially flat surface and can each be arranged or configured to mate with a corresponding electrically conducting contact on a complementary port connector.

In some embodiments, the port connector acting as a receptacle can be on the surface of a device. If the surface of the device is electrically conducting, the electrically conducting contacts can be mounted on a dielectric layer. In some embodiments, when at least two magnetic contacts are provided, they can be provided spaced apart and the plurality of electrically conducting contacts disposed between the magnetic contacts.

In various embodiments, where the peripheral device is headphones, the plurality of electrically conducting contacts can comprise: a ground contact, left audio contact, right audio contact, and a microphone contact. Each of contacts can be arranged to correspond with a complementary port connector to create an electrically conductive path. While the physical port connector may appear the same, the defined order of contacts can be determined by the device manufacturer or a standard can be established. In some embodiments, the contacts can be consistent with current TRRS (tip, ring1, ring2, and sleeve) standards. In other embodiments, one or more contacts can remain undefined or disconnected to wiring or electrical circuitry. This can be done to standardize production cost, but allow customization of use. In some embodiments, the headphone port connector can be four parallel electrically conducting strips disposed in association with at least one magnetic contact. In one or more aspects at least two magnetic strips can be provided and the electrically conducting strips disposed transversely between at least two of the magnetic strips. In one embodiment, a first magnetic strip of the at least two magnetic strips can be of positive polarity and a second magnetic strip of the at least two magnetic strips of negative polarity, each disposed separately apart and outwardly, with four electrically conducting strips disposed in parallel transversely in between the first and second magnetic strips, configured with the top electrically conducting contact strip as left audio, the second electrically conducting contact strip as right audio, the third electrically conducting contact strip as ground, and the bottom electrically conducting contact strip as microphone.

In some embodiments, the port connector can be four parallel electrically conducting strips disposed in parallel in association with at least one magnetic contact. In one or more aspects at least two magnetic strips can be provided and the electrically conducting strips disposed transversely between at least two of the magnetic strips. The contacts can be arranged or configured in complementary order to the complementary port connector acting as a plug. In one embodiment, a first magnetic strip of the at least two magnetic strips can be of positive polarity and a second magnetic strip of the at least two magnetic strips can be of negative polarity, each disposed separately apart and outwardly, with four electrically conducting strips disposed in between and in parallel with the magnetic strips, configured with the first electrically conducting contact strip as ground, the second electrically conducting contact strip as data+, the third electrically conducting contact strip as data−, and the bottom electrically conducting contact strip as Vcc (+5V).

In various embodiments, a system of port connectors is provided comprising a first connector and a second port connector are matingly connected to form a conductive path. The first port connector can comprise: a base, with a substantially flat surface; at least one magnetic contacts disposed within the substantially flat surface; a plurality of electrically conducting contacts disposed within the substantially flat surface; wherein the second port connector comprises: a base, with a substantially flat surface; at least one magnetic contact on the substantially flat surface; wherein each of the magnetic contacts are of the second port connector is arranged to mate with a the corresponding magnetic contact in the first port connector, wherein each of the magnetic contacts has a polarity to magnetically attract to the corresponding magnetic contact; and a plurality of electrically conducting contacts on the substantially flat surface; wherein each of the electrically conducting contacts are arranged to mate with a corresponding electrically conducting contact in the first port connector, thereby forming one or more conductive paths for signal or power. In an aspect, at least two magnetic contacts are disposed within the substantially flat surface of the first port connector and at least two magnetic contacts on the substantially flat surface of the second port connector.

In various embodiments, the system can be used to connect headphones, wherein the plurality of electrically conducting contacts comprise: a ground contact, left audio contact, right audio contact, and a microphone contact. In one embodiment of this system, both the plug of the headphones and the receptacle of the device can have the same contact configuration which will allow them to matingly connect. In one embodiment, the first port connector and the second port connector each can have the same configuration: at least one magnetic contact and four electrically conducting contacts disposed in association with the at least one magnetic contact, the magnetic contacts configured to attract each other. In an aspect each of the first and the second port connector can have at least two magnetic contacts, a first magnetic contact of positive polarity and a second magnetic contact of negative polarity disposed separately apart and outwardly, with four electrically conducting contacts disposed in parallel transversely there between the magnetic contacts, configured with the top electrically conducting contact as left audio, the second electrically conducting contact as right audio, the third electrically conducting contact as ground, and the bottom electrically conducting contact as microphone.

In other embodiments, the system can be an alternative to USB connectors, maintaining the specified standards. In various embodiments, the first port connector can be a flat-port plug and the second port connector a flat-port receptacle. In some embodiments, at least one magnetic contact is provided with a specified polarity configuration on the flat-port plug and the flat-port receptacle configured with magnetic contact(s) with opposite polarity to mate with the flat-port plug. In other embodiments, two or more magnetic contacts can use specified polarities on mating ports to ensure secure connection. In various embodiments, the plurality of electrically conducting contacts can comprise: a voltage (+5V) contact, a data− contact, a data+ contact, and a ground contact. In one embodiment, the port connector that is part to the peripheral device and considered a plug can be configured with at least one magnetic contact of positive polarity and a second magnetic contact of negative polarity, each disposed separately apart and outwardly, with four electrically conducting contacts disposed in between and in parallel with the magnetic strips, association with the at least one magnetic contact and configured with the first electrically conducting contact as Vcc (+5V), the second electrically conducting contact as data−, the third electrically conducting contact as data+, and the bottom electrically conducting contact as ground; with the second port connector that is part of the device and considered the receptacle configured in a complementary order with at least one magnetic contact of negative polarity and a second magnetic strip of positive polarity, each disposed separately apart and outwardly, with four electrically conducting contacts disposed in association with the at least one magnetic contact and configured with the first electrically conducting contact as ground, the second electrically conducting contact as data+, the third electrically conducting contact as data−, and the bottom electrically conducting contact as Vcc (+5V). In an aspect, each of the first and the second port connector can have at least two magnetic contacts, a first magnetic contact of positive polarity and a second magnetic contact of negative polarity disposed separately apart and outwardly with the electrically conducting contacts disposed in between and in parallel there between the magnetic contacts.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Therefore, the following is claimed:

1. A port connector comprising:

a base fabricated of a dielectric material having a substantially flat surface;

first and second magnetic contacts disposed within the substantially flat surface so that only a single surface of each of the first and second magnetic contacts is exposed, and a plurality of flat electrically conducting contacts disposed within the substantially flat surface so that only a single surface of each of the plurality of flat electrically conducting contacts is exposed, wherein the first and second magnetic contacts are placed on the base to exhibit opposite polarities.

2. The port connector of claim 1, wherein the first and second magnetic contacts are spaced apart and the plurality of electrically conducting contacts are disposed between the first and second magnetic contacts.

3. The port connector of claim 1, wherein the base is flexible.

4. The port connector of claim 1, wherein the port connector is embedded in a portable device.

5. The port connector of claim 1, wherein the plurality of contacts comprise: a left audio contact, a right audio contact, a ground contact, and a microphone contact to be compatible with a jack port.

6. The port connector of claim 5, wherein the first and second magnetic contacts are a pair of parallel magnetic strips with opposite polarity and the flat electrically conducting contacts are parallel strips disposed transversely between the pair of magnetic strips.

7. The port connector of claim 1, wherein the plurality of contacts comprise: a ground contact, a data+ contact, a data− contact, and a voltage (+5V) contact to be compatible with a USB port.

8. The port connector of claim 7, wherein the first and second magnetic contacts are a pair of parallel magnetic strips with opposite polarity and the flat electrically conducting contacts are parallel strips disposed in parallel between the pair of magnetic strips.

9. A port connector comprising:

a base fabricated of a dielectric material having a substantially flat surface;

first and second magnetic contacts on the substantially flat surface arranged to magnetically attract at least one corresponding magnetic contact on a complementary port connector; and a plurality of electrically conducting contacts on the substantially flat surface, wherein each of the electrically conducting contacts are arranged to mate with a corresponding electrically conducting contact on a complementary port connector, wherein the first and second magnetic contacts are placed on the base to exhibit opposite polarities, wherein the first and second magnetic contacts are formed within the substantially flat surface so that only a single surface of each of the first and second magnetic contacts is exposed, and wherein the plurality of electrically conducting contacts are formed within the substantially flat surface so that only a single surface of each of the plurality of electrically conducting contacts is exposed.

10. The port connector of claim 9, wherein the base is the surface of a device.

11. The port connector of claim 9, wherein the first and second magnetic contacts are spaced apart and the plurality of electrically conducting contacts are disposed between the first and second magnetic contacts.

12. The port connector of claim 9, wherein the plurality of electrically conducting contacts comprise: a left audio contact, a right audio contact, a ground contact, and a microphone contact to be compatible with a jack port.

13. The port connector of claim 9, wherein the plurality of contacts comprise: a voltage (+5V) contact, a data− contact, a data+ contact, and a ground contact to be compatible with a USB port.

14. A system of port connectors comprising a first port connector and a second port connector that are configured to be matingly connected to form a conductive path;

wherein the first port connector comprises:

a base, with a substantially flat surface;

at least one magnetic contact disposed within the substantially flat surface so that only a single surface of the at least one magnetic contact is exposed; and a plurality of electrically conducting contacts disposed within the substantially flat surface so that only a single surface of each of the plurality of electrically conducting contacts is exposed, wherein the plurality of electrically conducting contacts includes a center contact and additional contacts extending outward from the center contact; and wherein the second port connector comprises:

a base, with a substantially flat surface;

at least one magnetic contact on the substantially flat surface, having a polarity to magnetically attract to a corresponding magnetic contact of the first port connector; and a plurality of electrically conducting contacts on the substantially flat surface, wherein each of the electrically conducting contacts of the second port are arranged to mate with a corresponding electrically conducting contact in the first port connector, thereby forming one or more conductive paths for signal or power.

15. The system of claim 14, wherein the at least one magnetic contact comprises first and second magnetic contacts having opposite polarities.

16. The system of claim 14, wherein the plurality of electrically conducting contacts on the first port connector comprise: a ground contact, a left audio contact, a right audio contact, and a microphone contact to be compatible with a jack port; and the plurality of electrically conducting contacts on the second port connector comprise: a ground contact, a left audio contact, a right audio contact, and a microphone contact.

17. The system of claim 14, wherein the plurality of electrically conducting contacts on the first port connector comprise: a ground contact, a data+ contact, a data− contact, and a voltage contact to be compatible with a USB port; and the plurality of electrically conducting contacts on the second port connector comprise: a voltage contact, a data− contact, a data+ contact, and a ground contact.

* * * * *